US005541708A

United States Patent [19]

Tsuruoka

[11] Patent Number: 5,541,708

[45] Date of Patent: Jul. 30, 1996

[54] SYSTEM FOR TESTING AND OPTIMIZING TONER OUTPUT IN AN IMAGE FORMATING APPARATUS

[75] Inventor: Ryoichi Tsuruoka, Kanagawa, Japan

[73] Assignee: Fuji Xerox Co., Ltd., Tokyo, Japan

[21] Appl. No.: 186,652

[22] Filed: Jan. 26, 1994

[30] Foreign Application Priority Data

Apr. 6, 1993 [JP] Japan ..... 5-079469

[51] Int. Cl.[6] ..... G03G 21/00

[52] U.S. Cl. ..... 355/208; 355/246; 355/326 R

[58] Field of Search ..... 355/245, 246, 355/208, 326 R, 327

[56] References Cited

U.S. PATENT DOCUMENTS

| | | | |
|---|---|---|---|
| 4,684,243 | 8/1987 | Minor | 355/317 |
| 4,894,685 | 1/1990 | Shoji | 355/246 |
| 5,019,859 | 5/1991 | Nash | 355/208 X |
| 5,060,013 | 10/1991 | Spence | 355/208 |
| 5,298,944 | 3/1994 | Sawayama et al. | 355/208 |
| 5,313,252 | 5/1994 | Castelli et al. | 355/326 R |

*Primary Examiner*—Nestor R. Ramirez

*Attorney, Agent, or Firm*—Finnegan, Henderson, Farabow, Garrett & Dunner, L.L.P.

[57] ABSTRACT

An image density controlling device for an image formation apparatus includes a plurality of image formation devices. A plurality of transfer members carry an image formed by at least one of the plurality of image formation devices. A belt rotates synchronously with the operation of the image formation devices and carries the transfer members. The belt includes a plurality of transfer member carrying areas on which the plurality of the transfer members are respectively carried, and a plurality of non-carrying areas therebetween. A density detection toner image is formed in the non-carrying area by utilizing at least one of the plurality of image formation devices. The density of the density detection toner image is determined to output a density detection signal. The densities of the images transferred to the transfer members are then controlled in accordance with the density detection signal. The density detection toner image formed in each rotation cycle of the belt is cleaned off and formed again at a different position of the belt.

13 Claims, 9 Drawing Sheets

| ARRANGEMENT OF PATCHES AND SENSOR | | A. EXAMPLE OF NORMAL ARRANGEMENT | B. EXAMPLE OF ARRANGEMENT FOR PREVENTING CHANGE OF TONER IMAGE PATCH DENSITY IN FIRST IMAGE FORMATION MEANS |
|---|---|---|---|
| (1) | ARRANGED IN A LINE IN THE TRAVERSE DIRECTION | 20 ○ C ○ M ○ Y ○ K ↔ | ○ C ○ M ○ Y ○ K ○ K |
| (2) | ARRANGED IN A LINE IN THE DIRECTION OF BELT ROTATION | 20 ○ K Y M C | ○ K K Y M C |
| (3) | ARRANGED IN A COMBINATION OF LINES IN THE TRAVERSE AND BELT ROTATION DIRECTION | 20 ○ M C ○ K Y | ○ Y M C ○ K K |
| | | | ○ C ○ M ○ Y ○ K K |

FIG. 8

| | | PATCH FORMATION MODE IN SUCCESSIVE COPYING AN A3 SIZE DOCUMENT | | | | | | | | | | | | | | | | |
|---|---|---|---|---|---|---|---|---|---|---|---|---|---|---|---|---|---|---|
| | | | □ : PATCH IS FORMATED<br>⊡ : PATCH IS NOT FORMATED | | | | | | | | | | | | | | | |
| ARRANGEMENT OF FOUR PATCHES IN A LINE IN THE TRAVERSE DIRECTION | (1) ALL PATCHES ARE FORMED FOR EVERY OTHER TRANSFER SHEET | THE NUMBER OF ROTATION CYCLES OF TRANSFER BELT | N | | | | N+1 | | | | N+2 | | | | N+3 | | | |
| | | THE NUMBER OF TRANSFER SHEETS | 1 | 2 | 3 | 4 | 5 | 6 | 7 | 8 | 9 | 10 | 11 | 12 | 13 | | | |
| | | | □ | ⊡ | □ | ⊡ | ⊡ | □ | ⊡ | □ | □ | ⊡ | □ | ⊡ | ⊡ | | | |
| | | | □ | ⊡ | □ | ⊡ | ⊡ | □ | ⊡ | □ | □ | ⊡ | □ | ⊡ | ⊡ | | | |
| | | | □ | ⊡ | □ | ⊡ | ⊡ | □ | ⊡ | □ | □ | ⊡ | □ | ⊡ | ⊡ | | | |
| | | | □ | ⊡ | □ | ⊡ | ⊡ | □ | ⊡ | □ | □ | ⊡ | □ | ⊡ | ⊡ | | | |
| | (2) A PAIR OF PATCHES AND ANOTHER PAIR OF PATCHES IN A LINE ARE ALTERNATELY FORMED | THE NUMBER OF ROTATION CYCLES OF TRANSFER BELT | N | | | | N+1 | | | | N+2 | | | | N+3 | | | |
| | | THE NUMBER OF TRANSFER SHEETS | 1 | 2 | 3 | 4 | 5 | 6 | 7 | 8 | 9 | 10 | 11 | 12 | 13 | | | |
| | | | □ | ⊡ | □ | ⊡ | ⊡ | □ | ⊡ | □ | □ | ⊡ | □ | ⊡ | ⊡ | | | |
| | | | □ | ⊡ | □ | ⊡ | ⊡ | □ | ⊡ | □ | □ | ⊡ | □ | ⊡ | ⊡ | | | |
| | | | ⊡ | □ | ⊡ | □ | □ | ⊡ | □ | ⊡ | ⊡ | □ | ⊡ | □ | □ | | | |
| | | | ⊡ | □ | ⊡ | □ | □ | ⊡ | □ | ⊡ | ⊡ | □ | ⊡ | □ | □ | | | |
| ARRANGEMENT OF FIVE PATCHES IN A LINE IN THE TRAVERSE DIRECTION | (3) AN ADDITIONAL PATCH FOR A CERTAIN COLOR AND AN ORIGINAL PATCH FOR THAT COLOR ARE FORMED ALTERNATELY, AND PATCHES FOR OTHER COLORS ARE FORMED FOR EVERY TRANSFER SHEET | THE NUMBER OF ROTATION CYCLES OF TRANSFER BELT | N | | | | N+1 | | | | N+2 | | | | N+3 | | | |
| | | THE NUMBER OF TRANSFER SHEETS | 1 | 2 | 3 | 4 | 5 | 6 | 7 | 8 | 9 | 10 | 11 | 12 | 13 | | | |
| | | | □ | □ | □ | □ | □ | □ | □ | □ | □ | □ | □ | □ | □ | | | |
| | | | □ | □ | □ | □ | □ | □ | □ | □ | □ | □ | □ | □ | □ | | | |
| | | | □ | □ | □ | □ | □ | □ | □ | □ | □ | □ | □ | □ | □ | | | |
| | | | □ | ⊡ | □ | ⊡ | ⊡ | □ | ⊡ | □ | □ | ⊡ | □ | ⊡ | ⊡ | | | |
| | | | ⊡ | □ | ⊡ | □ | □ | ⊡ | □ | ⊡ | ⊡ | □ | ⊡ | □ | □ | | | |

FIG. 9

SYSTEM FOR TESTING AND OPTIMIZING TONER OUTPUT IN AN IMAGE FORMATING APPARATUS

BACKGROUND OF THE INVENTION

1. Field of the Invention

The present invention relates to an image formation apparatus in a copying machine, facsimile, printer or the like, and in particular to an image density controlling device for a color image formation apparatus having a plurality of image formation means such as light-sensitive members for electrophotography, and performing an electrophotographic image formation process on the light-sensitive members to form a developed image of one or more colors, and transferring the image to a transfer member carried by a transfer member carrying means or an intermediate transfer member.

2. Discussion of the Related Art

The U.S. Pat. Nos. 2,576,882 and 3,357,325, for example, disclose an image formation apparatus wherein an insulating transfer belt or the like moving synchronously with an image formation means has a transfer sheet electrostatically adhered thereto and carries it to a transfer position of the image formation means, and transfers a toner image formed on the image formation means by an electric field on the reverse side of the insulating transfer belt to the transfer sheet.

One advantage of a method of transferring images to each of the transfer sheets by using the above-described insulating transfer belt as the transfer sheet carrying means, is that it has a sufficient transfer, charge capacity to counteract the increased toner weight of a plurality of superimposed toner images.

The image formation apparatus of this type comprises a first corona discharger for electrostatically attaching the transfer sheet to the transfer belt, a second corona discharger for generating an electric field on the reverse of the transfer belt by corona discharge for transfer of the toner image, a detachment corona discharger discharging for and detaching the transfer sheet from the transfer belt after transfer is finished, and an alternating corona discharger discharging the transfer belt.

As for the method of discharging the transfer belt, Japanese Patent Application Unexamined, Publications Nos. Sho. 63-195350 (1988), Sho. 63-195351 (1988) and Sho. 63-195352 (1988) suggest a method wherein the detachment corona discharger is disposed between the last transfer process and the first transfer process of the next cycle.

Since there is the possibility of contamination of the reverse side of the subsequent transfer sheet by toner attaching the surface of the transfer belt when the transfer sheets are jammed or a toner image formed on the light-sensitive member does not fit to the transfer sheet, a cleaner is provided to clean the surface of the transfer belt for carrying the transfer sheet.

Moreover, in the image formation apparatus forming a color image by using a plurality of light-sensitive members, registration errors of the transfer sheet in the direction of transportation are apt to occur. To prevent these errors, Japanese Patent Application Unexamined Publication No. Sho. 63-300263 (1988) proposes a method of transferring a pattern for correcting registration errors, reading the position of the pattern with a CCD or similar sensor, automatically registering the images of each color and cleaning off the pattern.

Japanese Patent Application Unexamined Publications Nos. Sho. 63-279275 (1988), 63-279276 (1988) and 61-53756 (1986) disclose a method of transferring a pattern for correcting registration errors, reading the position of the pattern by a photosensor or the like, and at the same time controlling the density of each color toner in accordance with the output of the photosensor.

Cleaning the surface of the transfer belt has been accomplished using a cleaning blade, fur brush, web or the like and combinations thereof.

There are some problems in the method of transferring the pattern for correcting the registration errors or a toner image patch for controlling the image density on the transfer belt and reading it with the photosensor, which are as follows.

In the image formation apparatus forming a color image by using a plurality of image formation means 1*a*, 1*b*, 1*c* and 1*d* shown in FIG. 1, the change of potential of a transfer belt 2 in each of the processes of transferring the toner image patches of different colors for controlling image density with a standard density of 70%, for example, to the surface of the transfer belt 2 one by one, detecting the image density by a photosensor 3 after the last image formation means 1*d* completes the transfer, discharging the transfer belt 2 by a detachment corona discharger 4, and removing the toner image patches on the surface of the transfer belt 2 by a cleaning means 5, are shown in FIG. 2.

In FIG. 1, 6 is a belt discharging means for discharging the transfer belt 2, 7 is a cleaning means for cleaning the transfer belt 2 and 8 is an attachment means, whose working areas are indicated as A, B and C, respectively, in FIG. 2. Transfer areas of the image formation means 1*a*, 1*b*, 1*c* and 1*d* are respectively indicated as D, E, F and G, and detaching means 4 and 5 are indicated as working area H in FIG. 2.

After passing through the working area G of the last (fourth) image formation means 1*d*, the surface of the transfer belt 2 has a charge of about (–) 4000 V, and after passing the belt discharge means 6 (through working area A), the charge of portions of the transfer belt surface on which no toner image patches for controlling the image density are formed or portions where the transfer sheets are attached is reduced to approximately (–) 100 V. However, as indicated by a broken line in FIG. 2, a charge of about (–) 400 to 600 V remains on portions where the toner image patches for controlling the image density are present in the working area A. Even after passing through the working area B of the cleaning means 7 and the working area C of the attachment means 8, the charge still remains. This is because the surface of the transfer belt 2 cannot be sufficiently discharged by applying an alternating corona discharge over the toner image patches, though the toner image on the surface of the transfer belt 2 can be discharged. As shown in FIG. 2, the influence of the residual charge gradually reduces in the subsequent processes of the image formation means, but still remains.

The transfer belt 2 is an insulating belt with a join. The part of the transfer belt 2 corresponding to the working areas of image transfer D, E, F and G is equally divided into an integral number of panels and the toner image patches are transferred for every cycle of the transfer belt rotation the same areas between the panels where no image transfer is carried out. FIG. 3 shows the state of discharge of the transfer belt 2 when the patch transfer process described above is repeated.

In FIG. 3, during the first cycle of the image formation, the charge on the transfer belt 2 is approximately 0 V because the whole belt is positively discharged in advance.

During the second and subsequent cycles, a charge of (–) 300 to (–) 400 V remains on the portions of the toner image patches for controlling the image density transferred to the areas where no image transfer is carried out. The characteristics shown in FIG. 3 are under the conditions of normal temperature and humidity. FIG. 4 shows the characteristics in the low temperature and humidity, where the efficiency of the discharge is decreased and the residual charge is about (–) 500 to (–) 600 V.

If the transfer belt 2 with the residual charge of the above-described amount is advanced to the working area C of the attachment means 8 for the next transfer sheet and the subsequent working areas D, E, F and G of the image formation means, the difference in the residual charges between the portions of the toner image patches for controlling the image density and the portions without them is gradually reduced, but the residual charge at the first image formation means 1*a* becomes a maximum, as shown in FIG. 2.

FIG. 5 shows the relationship between the residual charge on the transfer belt 2 and the transfer efficiency of the toner in the working area D of the first image formation means 1*a*. As seen from the figure, the residual charge on the transfer belt 2 after passing through the belt discharge means 6 is more than (–) 200 V, and the transfer efficiency in the first working area D is severely reduced. The transfer efficiency is evaluated by the weight of toner transferred from the toner image patch.

As seen from FIG. 6, the density of the toner image patch also affects the variation of the residual charge on the transfer belt after passing through the detachment corona discharger 4. As the toner weight of the toner image patch increases, the amount of the residual charge on the transfer belt 2 becomes larger, and therefore it is preferable to restrict the toner weight of the toner image patch to approximately 0.6 mg/mm$^2$ or less.

SUMMARY OF THE INVENTION

The present invention has been made in view of the above circumstances and has as an object the provision of an image density controlling method for an image formation apparatus controlling the image density by reading the density of toner image patches transferred to areas on a transfer belt where no image is transferred, which stably performs control of the image density by forming the toner image patches with a certain density on the transfer belt regardless of the discharge state of the toner image patch portions on the transfer belt.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the object and in accordance with the purpose of the invention, as embodied and broadly described herein, the image density controlling device for the image formation apparatus of this invention comprises a plurality of image formation means, a plurality of transfer members to each of which an image formed by at least one of the plurality of the image formation means is transferred, endless belt means rotating synchronously with the operation of the image formation means with carrying the transfer members, the endless belt means including a plurality of transfer member carrying areas on which the plurality of the transfer members are carried respectively, and at least one non-carrying area therebetween, means for forming a density detection toner image in the non-carrying area by utilizing at least one of the plurality of the image formation means, means for detecting the density of the density detection toner image to output a density detection signal showing detected density, means for controlling the density of the image transferred to the transfer members in accordance with the density detection signal, belt discharging means for removing charge from the endless belt means, means for cleaning off the density detection toner image in each rotation cycle of the endless belt means, and the means for forming a density detection toner image controlling the position where the density detection toner image is formed to be different from the position where the density detection toner image was previously formed in each rotation cycle of the endless belt means.

BRIEF DESCRIPTION OF THE DRAWINGS

The accompanying drawings, which are incorporated in and constitute a part of this specification illustrate embodiments of the invention and, together with the description, serve to explain the objects, advantages and principles of the invention. In the drawings.

FIGS. 8 (1)*a*.–(3)*b*. show example arrangements of the toner image patches and sensors;

FIGS. 9 (1)–(3) show some example arrangements of the toner image patches in detail;

DETAILED DESCRIPTION OF THE PREFERRED EMBODIMENTS

A preferred embodiment of an image density controlling method for an image formation apparatus according to the present invention is now described in detail based on FIGS. 1 and 7–11.

Figure 1:
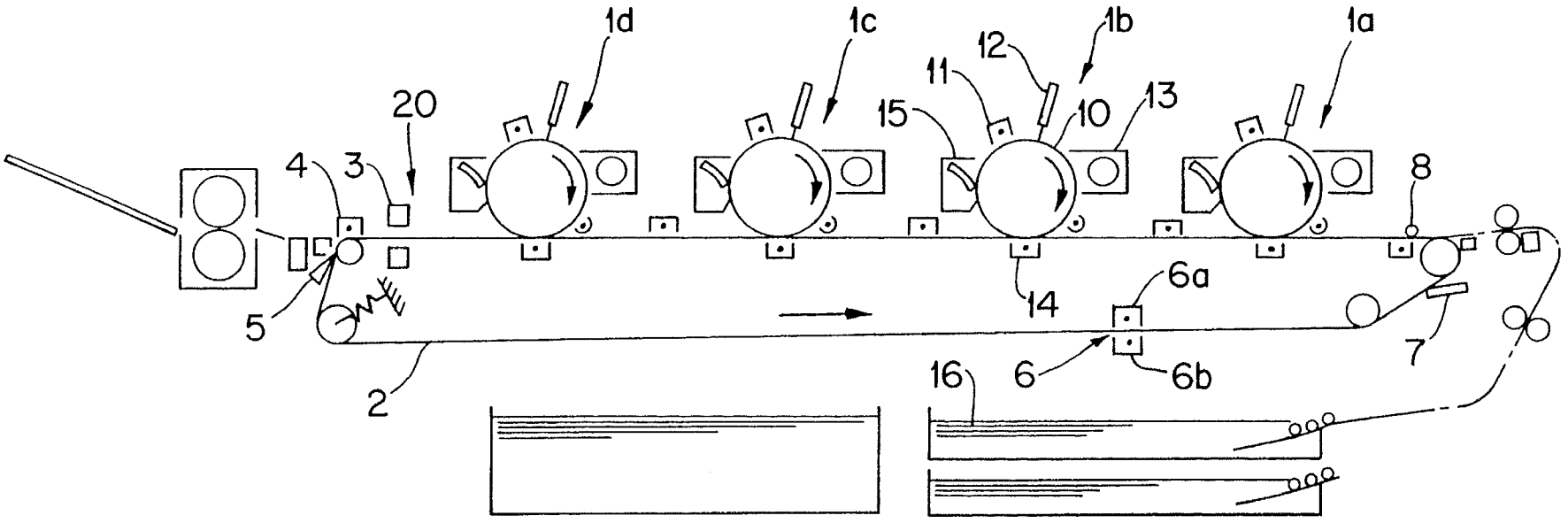
FIG. 1 is a schematic view showing the construction of an image formation apparatus having a plurality of image formation means.
Figure 2:
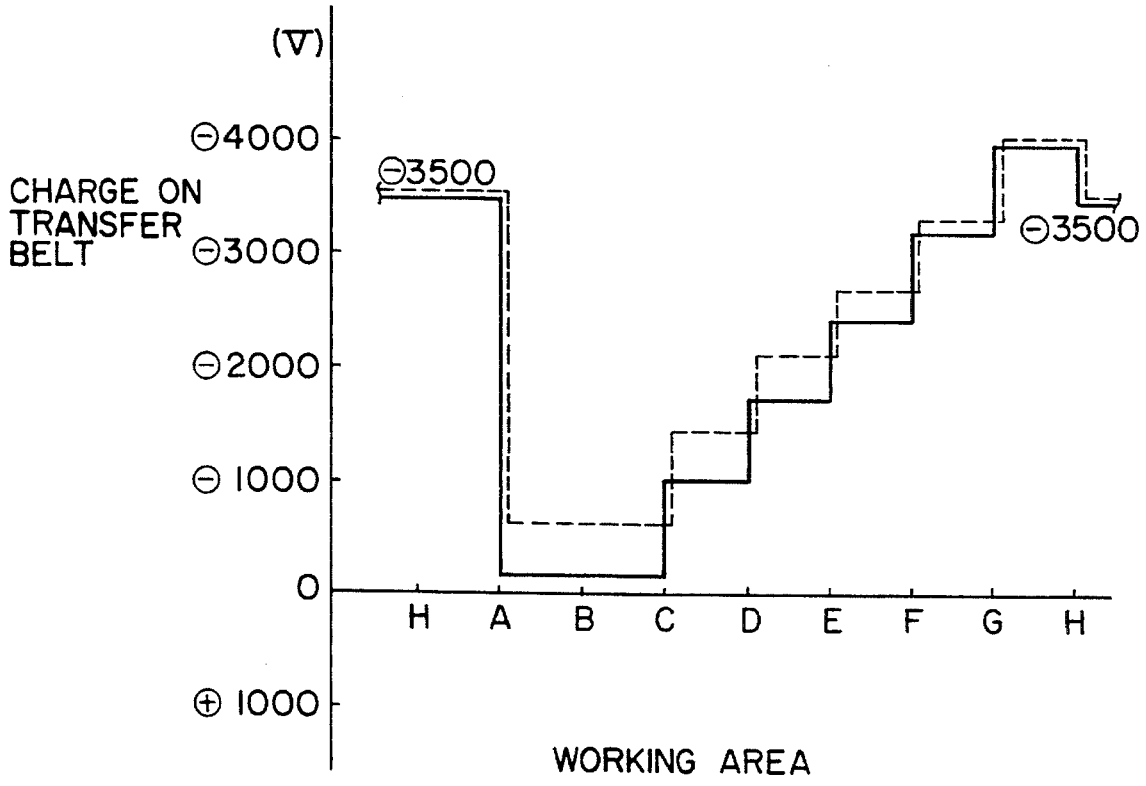
FIG. 2 PRIOR ART
FIG. 2 is a diagram showing a variation of the potential on a transfer belt in the processes of the image formation apparatus shown in FIG. 1.
Figure 3:
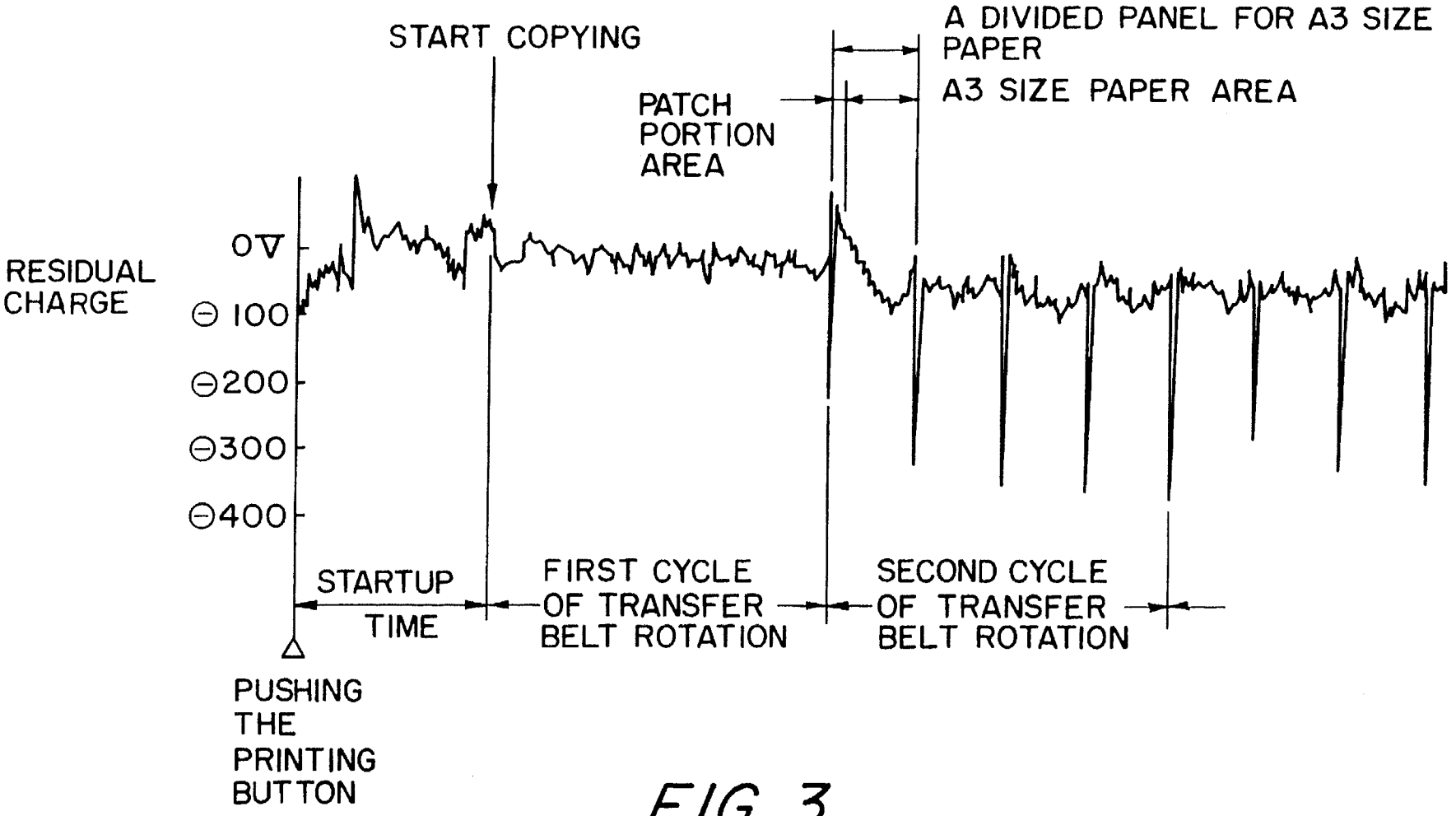
FIG. 3 PRIOR ART
FIG. 3 is a diagram showing the state of discharge of the transfer belt when the process of transfer of the toner image patches to the same position in every rotation cycle of the transfer belt is repeatedly carried out in normal temperature and humidity.
Figure 4:
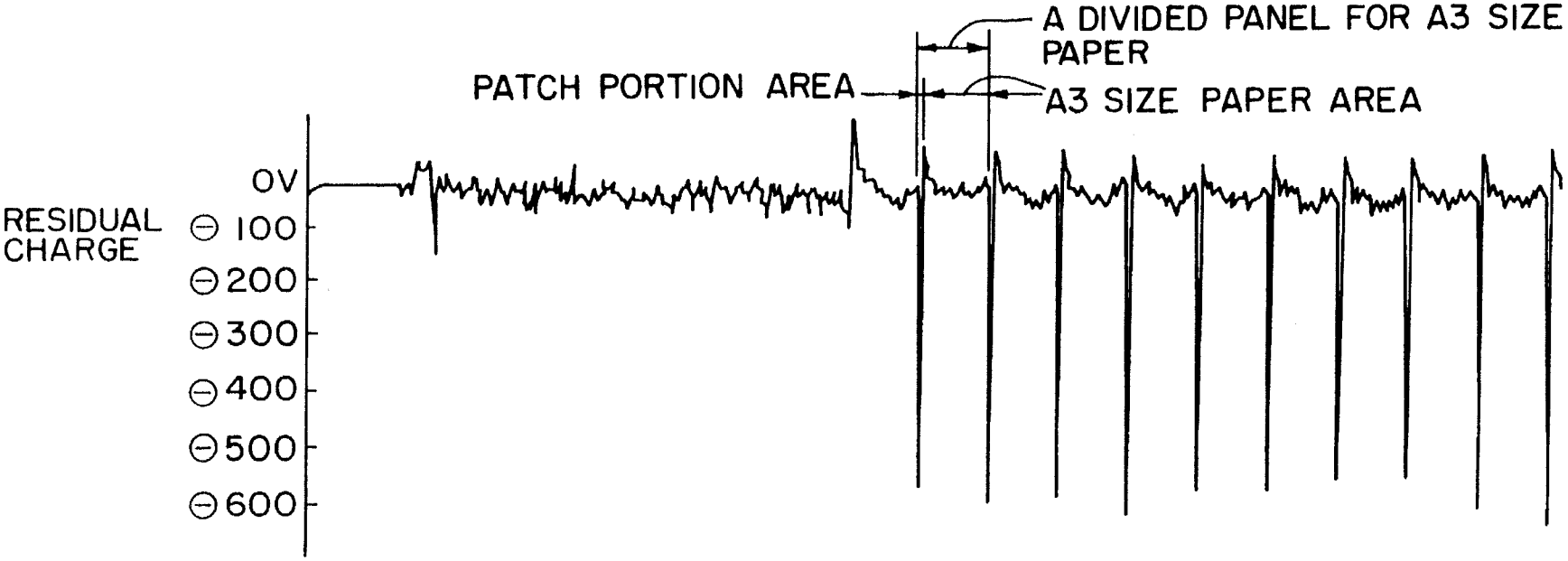
FIG. 4 PRIOR ART
FIG. 4 is a diagram showing the state of discharge of the transfer belt when the process of transfer of the toner image patches to the same position in every rotation cycle of the transfer belt is repeatedly carried out in low temperature and humidity.
Figure 5:
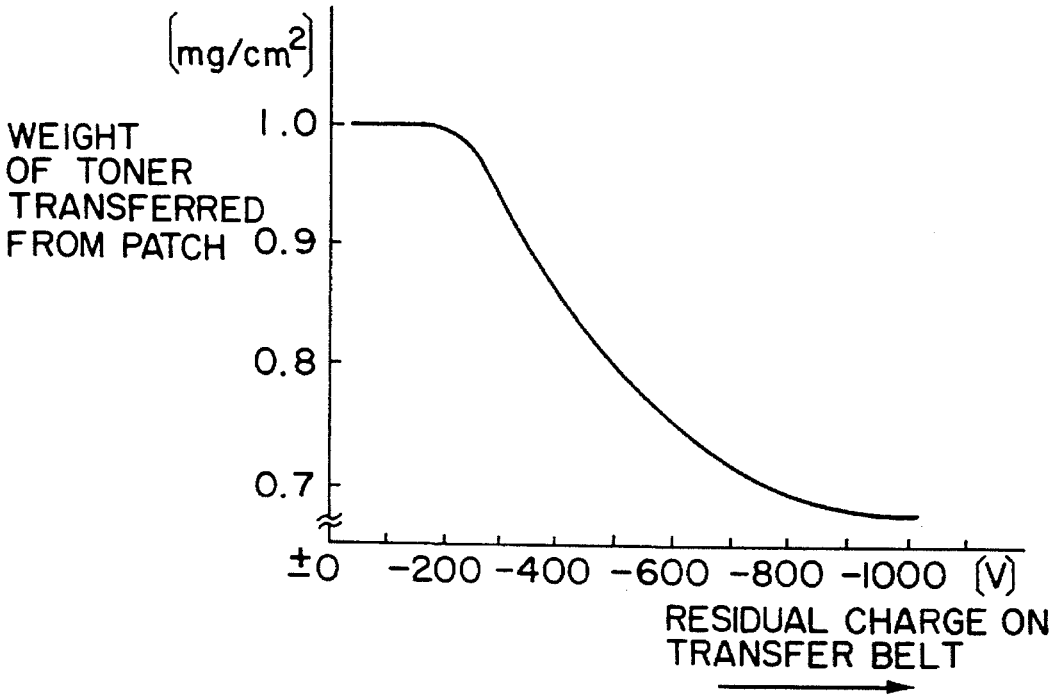
FIG. 5 PRIOR ART
FIG. 5 is a diagram showing the relationship between the potential and transfer stability after the toner image patch portions are discharged.
Figure 6:
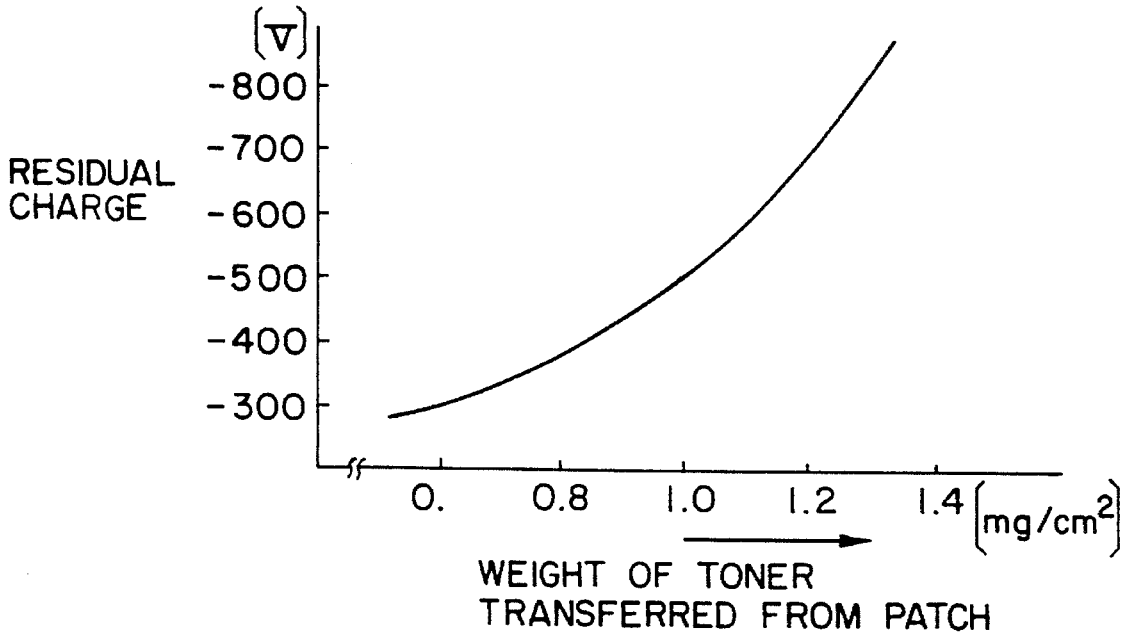
FIG. 6 PRIOR ART
FIG. 6 is a diagram showing the relationship between the density of the toner image patch on the transfer belt and the residual charge on the toner image patch portions after discharging.
Figure 7:
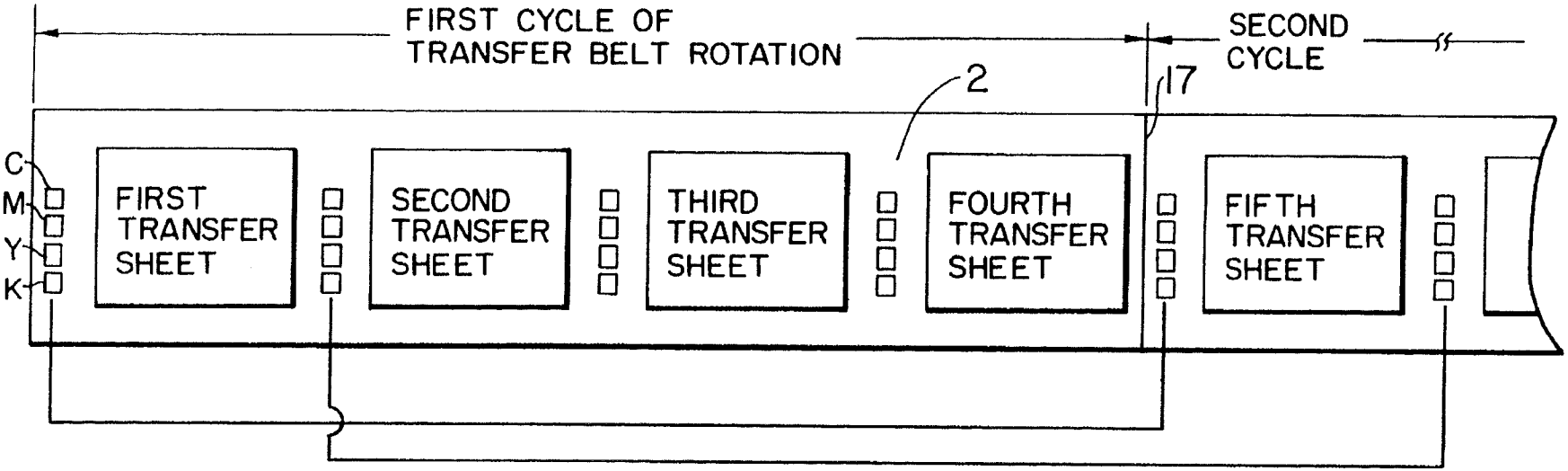
FIG. 7 shows the lengthwise division of the transfer belt into plural panels and a pattern of arrangement of the toner image patches.

The image formation apparatus shown in FIG. 1 employs this embodiment, in which each of the image formation means 1*a*, 1*b*, 1*c* and 1*d* include an image formation member (light-sensitive drum) 10 facing a transfer belt 2 and rotatably supported about an axis, and a first charger 11, an optical image input portion 12, a developing means 13, and a transfer corotron discharger 14 arranged on the reverse side of the transfer belt 2, and a cleaning device 15.

The toner image developed by the developing means 13 on the image formation member 10 is transferred to the transfer sheet carried on the transfer belt 2 disposed in contact with each of the image formation members 10 by a corresponding transfer corotron charger 14.

The transfer belt 2 may be used with high insulation materials such as polyethyleneterephthalate, polyvinylidene fluoride resin, polyester, polycarbonate, or polyetheretherketone film, which are cut into a predetermined size and formed into an endless belt by ultrasonic welding of the ends for carrying the transfer sheets.

In this embodiment, a polyethyleneterephthalate film with thickness of 50–200 μm and volume resistivity of $10^{16}$–$10^{20}$ Ωcm is used as the transfer belt. The diameter of the image formation member 10 is 84 mm, the length of the transfer belt 2 is 1920 mm, and space between the axes of two image formation members, namely, the distance between developing points is 196 mm.

In the above-described image formation apparatus, the transfer corona dischargers 14 of image formation means 1*a*–1*d* apply different voltages, for example, 4.2–12.0 kV; therefore the total current for the transfer process ranges from 50 to 2000 μA. A detachment means for removing the transfer sheet on which a toner image is transferred from the transfer belt 2 comprises a detachment corona discharger 4 for reducing the electrostatic attachment force and a detaching claw 5 made of an insulating material such as a plastic. The detachment corona discharger 4 of the detachment means is capable of applying a DC bias voltage superimposed on an AC voltage.

Inside charge discharger 6*a* disposed inside of the transfer belt 2, and outside charge discharger 6*b* disposed outside of the transfer belt 2 of the detachment corona discharger 6, as well as the detachment means, are corona dischargers capable of applying the DC bias voltage superimposed on the AC voltage.

In addition to the above-described construction, this embodiment further comprises a reflective type photosensor consisting of a light emission portion and a light detecting portion for detecting the position of the seam of the transfer belt 2. Because the seam of the transfer belt 2 is formed by joining the ends of a cut sheet such as a film by ultrasonic welding, for example, the seam portion is thicker and the dielectric constant thereof is different from other portions, and consequently the charge imparted to the portion corresponding to the seam portion on the transfer sheet differs from other portions of the transfer sheet causing irregularities in density of the transferred image on the part corresponding to the seam portion.

To avoid this problem, Japanese Patent Application Unexamined Publication No. Sho. 62-269160 (1987) discloses a seam detector in which a hole or a pattern is formed at a position at a predetermined distance from a seam portion of a transfer belt and a photosensor detects the hole or pattern to recognize the position of the seam of the transfer belt. This seam detector further comprises a pulse generator which outputs a pulse signal for every movement of the transfer belt for a predetermined distance and a counter for counting the pulses, wherein the number of pulses in one revolution of the transfer belt is divided equally into the number of image areas to determine the image areas. Hereafter, this operation will be referred to as a panel division.

By this method, timing to start advancing the transfer sheets avoiding the seam is determined and the transfer belt is divided into plural parts of equal lengths avoiding the seam portion in accordance with the size of the transfer sheet, thus arranging so that there are an integral number of transfer sheets for each rotation cycle of the transfer belt.

For example, panel division in the case where the length of the transfer belt is 1920 mm is now explained.

When panel division is used to divide the transfer belt of the above-described length into 4–8 panels is carried out, the divisions are as shown in Table 1.

TABLE 1

| Sheet size | Number of panels after division | Interval between transfer sheets on the transfer belt (mm) |
|---|---|---|
| A4 transverse | 8 | 30 |
| B4 longitudinal | 4 | 116 |
| A3 longitudinal | 4 | 60 |

When the transfer belt is divided into panels as described above, it is convenient and most productive to control the seam 17 of the transfer belt 2 to be located approximately at the center of the interval between transfer sheets. To increase the operation rate, it might be possible to ignore the seam and use the portion corresponding to the seam as the image area. However, as described above, since the seam portion is thicker than the other portions, the dielectric constant of the seam portion is different from the other portions, which causes defects in the transferred image. Though toner attached to the surface of the transfer belt 2 is removed by the cleaning device 15, some toner remaining on both ends of the seam portion, where the thickness of the transfer belt 2 changes, evades the cleaning device 15 and is transferred to the reverse of the next transfer sheet carried on the seam portion. Therefore this method is not a suitable one.

Next a method for transferring the toner image patch on the non-image area of the transfer belt 2 for controlling the image density will be described.

In FIG. 1, the toner image patch density detecting means 20 for all toner colors comprising the photosensor 3 is disposed at a point next to the working area of the last image formation means 1*d*. The density of the toner image patch transferred to a polyethyleneterephthalate film is read out by the photosensor, comprising a photoemitter and photoreceptor disposed above and beneath the transfer belt 2, by converting the amount of the transmitted light into an output voltage of the photosensor, that is, a density detection signal. According to the output voltage, a toner replenishment signal is controlled to be on or off.

Several different arrangements of the sensor and toner image patches transferred to the transfer belt 2 for controlling the density in a full color image formation process might be considered, and some of those are shown in FIGS. 8 (1)*a*.–(3)*b*. In these figures and FIG. 7, K, Y, M and C are toner image patches for black, yellow, magenta and cyan, respectively, which further correspond to the first, second, third and fourth image formation means 1*a*–1*d*, respectively.

The arrangement of the toner image patches and sensor may be considered as follows: (1) a line in the transverse direction, (2) a line in the direction of belt rotation, and (3) a combination of lines in the transverse and belt rotation direction.

When (1) is employed, that is, the toner image patches are formed in a line in the transverse direction, each toner image needs a sensor, but the extent of the toner image patches in the longitudinal direction is small, and therefore the spacings between the transfer sheets are reduced and the operation rate increases.

In the case where A4 size sheets are transversely arranged on the above-described transfer belt 2 with a length of 1920 mm and the spacing between the transfer sheets is 30 mm, the spacing is ample to hold the toner image patches even assuming they are 16-mm square, which makes it possible to transfer the toner image patches to the areas between the transfer sheets in every copying cycle, thus providing the highest capability of controlling the image density.

When the toner image patches are disposed in the longitudinal direction of rotation of the transfer belt 2, it is sufficient to have one set of the density detecting means 20, but is necessary to have a considerably large spacing between the transfer sheets. Assuming the toner image patch is 16-mm square and the spacing between the patches is 2mm, the space is required in accordance with the following expression:

$$(16\ \text{mm}\times 4)+6+2\alpha=70\ \text{mm}+2\alpha$$

wherein $\alpha$ is the margin at each end of the transfer sheet. $\alpha$ is at least approximately 4 mm, taking into consideration the registration errors of transfer sheets with respect to the image to be transferred caused by a sheet feeding means, skew of the transfer sheet, irregular timing for forming the toner image patches, inaccurate detection by the sensor for detecting the seam position of the transfer belt 2, and so forth.

In this case, accordingly, a spacing between the transfer sheets of $$70+(2\times 4)=78\ \text{mm}$$

is necessary.

When A4 size sheets (210 mm×297 mm) are transversely arranged on the transfer belt 2 with the length of 1920 mm and the belt is divided into 7 panels, the spacing between the transfer sheets is $$(1920-7\times 210)/7=64.3\ \text{mm}$$

which is insufficient. It is necessary to reduce the number of panels to 6 to satisfy the demand for the size of spacing, which is calculated as follows:

$$(1920-6\times 210)/6=110\ \text{mm}.$$

Suppose that the process speed of the transfer belt 2 is 160 mm/s and the time required for one rotation cycle of the belt is 12 s. In the case where the number of the divided panels is 8, the copying speed is $$60s/12s\times 8=40\ \text{sheets/s}.$$

In the case of 6 panel-division, however, the copying speed is $$60\ s/12s\times 6=30\ \text{sheets/s},$$

thus extremely reducing the operation rate.

In the above-described example, the toner image patches are transferred to the transfer belt 2 in every copying cycle to detect their density. However, as a means for overcoming the problem mentioned above, limitation of the patch transfer operation to the first copying cycle can be considered. If the limitation is carried out, even though the toner image patches are arranged in a line in the direction of the rotation of the transfer belt 2 and A4 size transfer sheets are transversely disposed on the belt, 7 transfer sheets can be successively carried during one rotation cycle of the belt by transferring the patches only to the first panel out of 8 divided panels. But, in this case, there occurs another problem that reliability is extremely reduced from the viewpoint of maintenance of the image quality in the use of a copying machine for full-color image which is required to strictly maintain the image density.

The formation of the toner image patches and arrangement thereof have been explained; next is described a method for preventing variation of the capability for transferring the toner image patches between the first cycle and the second and subsequent cycles of the belt rotation in the image formation process, which is caused by insufficient discharge of toner image patch portions on the transfer belt 2. In the following examples, A3 size paper is used as the transfer sheets and the number of the divided panels is 4, that is, 4 transfer sheets are continuously supplied on the transfer belt 2 during one rotation cycle of the belt. Though the size of the paper is changed, all operations are the same as the following examples except for the number of the divided panels.

In all of the following cases, the transfer sheet is guided by the transfer belt 2 from the first image formation means to the last image formation means, where each image formation means transfers an image to the transfer sheet and toner image patches for controlling the image density to an area between the transfer sheets on the transfer belt (where no image is transferred), whereby the toner image patches in their various arrangements are transferred to the non-image area as shown in FIG. 9 and the photosensor for reading the density is disposed at the position corresponding to the toner image patch formation position in the direction of the transfer belt rotation. In FIG. 9, the rotation cycle numbers N, N+1, N+2, and so forth of the transfer belt mean the number of rotation cycles of the transfer belt after a printing button of the image formation apparatus is pushed to operate the apparatus and the image formation process is started. In practice, after pushing the printing button and the lapse of a predetermined startup time of the apparatus, the image formation process is started when N=1.

EXAMPLE 1

Arranging the toner image patches and sensors in a line in the transverse direction of the transfer belt—1

FIG. 9 (1) shows this case. In the four panels of the first rotation cycle, four toner image patches are transferred to the non-image area at the end portion of the first and third panels and no toner image patches are transferred to the non-image area at the end portion of the second and fourth panels. In the second rotation cycle, no toner image patches are transferred to the non-image area at the end portion of the first and third panels and the toner image patches are transferred to the non-image area at the end portion of the second and fourth panels. As a result, each panel goes through the toner image patch transfer every other rotation cycle of the belt. Repetition of the above-described operation resolves the difficulty of image density control caused by variation in the capability for transferring the toner image patches between N and N+1 rotation cycles generated by insufficient discharge of the toner image patch portion of the transfer belt as described above.

EXAMPLE 2

Arranging the toner image patches and sensor in a line in the transverse direction of the transfer belt—2 .

This example is shown in FIG. 9 (2). It is a variation of example 1, wherein the four toner image patches arranged in a line are divided into two groups each of which is alternatively transferred. That is, during the first rotation cycle, toner image patches belonging to group 1 are transferred to the non-image area at the end portion of the first and third panels out of four panels and the patches belonging to group 2 are transferred to the non-image area at the end portion of the second and fourth panels. On the other hand, during the second rotation cycle, the patches of the group 2 are transferred to the non-image portion at the end portion of the first and third panels and the patches of the group 1 are transferred to the non-image area at the end portion of the second and fourth panels. As a result, the two groups of toner image patches are transferred for every other rotation cycle of the belt. Repetition of the above-described operation resolves the difficulty in image density control caused by variation in the capability for transferring the toner image patches between N and N+1 rotation cycles generated by insufficient discharge of the toner image patch portion of the transfer belt, the same as in example 1.

In the two examples described above, the toner image patch formation and detection of density for each color are carried out alternately during one rotation cycle. Of course, it is most preferable to form the toner image patches and detect their density for every divided panel. As previously described, in the first image formation means, failure to control the image density caused by variation of the capability for transferring the toner image patches between N and N+1 rotation cycles due to the insufficient discharge of the toner image patch portions on the transfer belt occurs with great severity.

In a full-color image copying process, the frequency of use of black toner is lower than that of the yellow, magenta and cyan colors to form an image; and therefore the frequency of formation of the toner image patches for controlling the image density for black toner may be lower than those of the three other color toners.

Taking the above-described matters into consideration, another method of toner image patch formation is now described, which is shown in FIG. 8 (1)*b*. In this case, the black toner which is of lowest frequency in use is assigned to the first image formation means and two toner image patch portions are prepared and the patches for controlling the black toner image are formed on the alternate portions in rotation cycles of the belt while patches for other color images are formed on the respective portions in every rotation cycle. Therefore, the frequently used colors yellow, magenta and cyan are used in every coping cycle. Moreover, toner image patches in every copying cycle, and moreover, is the problem peculiar to the color black is resolved, that is, the variation of capability for transferring the toner image patches between N and N+1 rotation cycles occurs with great severity due to insufficient discharge of the toner image patch portions.

For example, as shown in FIG. 9 (3), in each of the cases where the toner image patches are arranged in a line in the transverse direction of the belt, where the toner image patches are arranged in a line in the longitudinal direction of the belt, and where the toner image patches are arranged in a combination of lines in the transverse direction and longitudinal directions, two toner image patch portions for black toner are provided, and the toner image patch formation and detection of the image density for the colors other than black are carried out at the portion for patch formation corresponding to each color in every copying cycle, while the toner image patches for black toner are transferred to two portions in alternate rotation cycles of the transfer belt and the image density thereof is detected.

Figure 10:
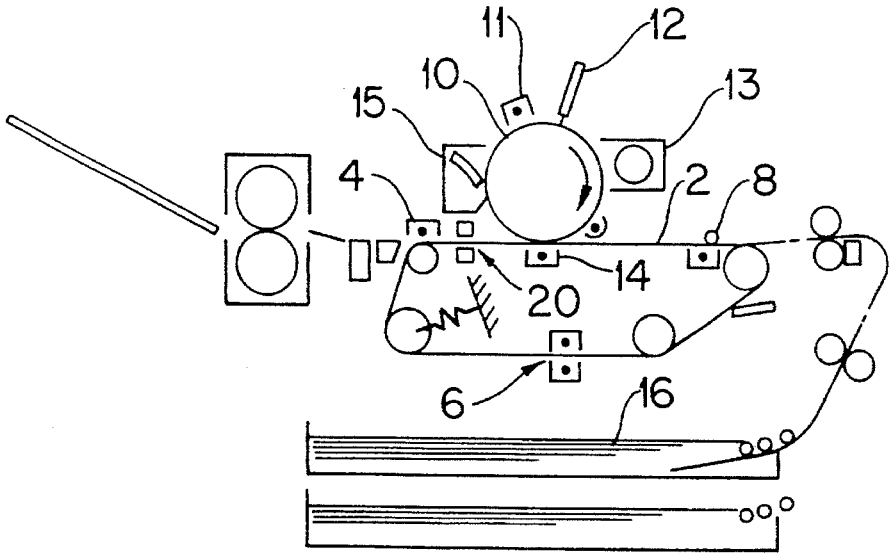
FIG. 10 is a schematic view showing the construction of an image formation apparatus having an image formation means.

FIG. 10 shows an embodiment using one image formation means and a transfer belt for carrying transfer sheets.

The previous embodiment describes the image formation apparatus having a plurality of image formation means, but as shown in FIG. 10, the image density controlling method of the present invention is applicable to an image formation apparatus having a single image formation means.

Figure 11:
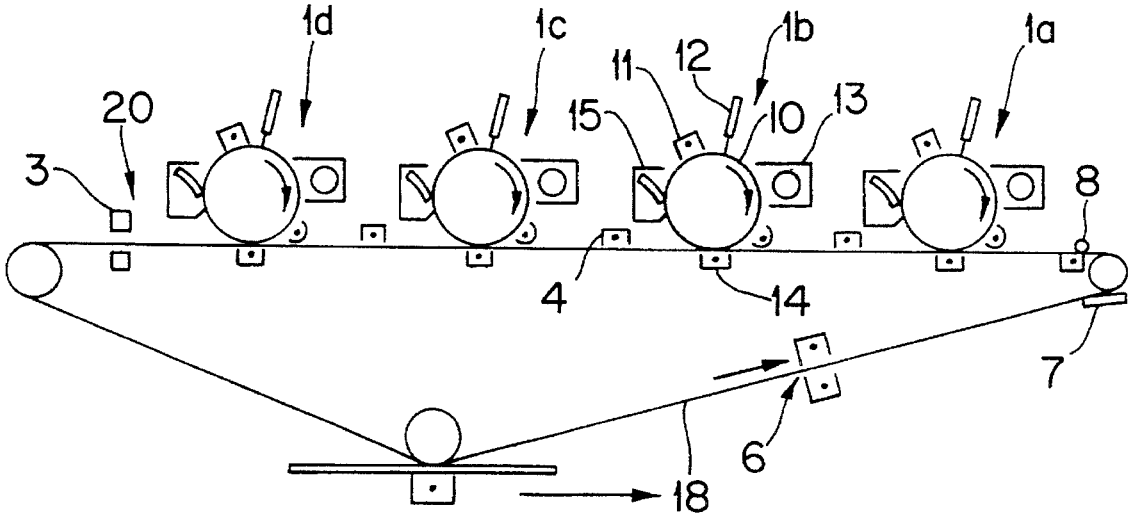
FIG. 11 is a schematic view showing the construction of an image formation apparatus wherein a moving member is used as an intermediate transfer member.

Again, in the previous embodiment, the moving member is a means for carrying the transfer member such as a transfer belt carrying a transfer sheet on which an image is formed by the image formation means. However, as shown in FIG. 11, it is possible to use an intermediate transfer member 18 as the moving member, to which an image formed by the image formation means is primarily transferred and then secondarily transferred to the transfer sheet.

According to the present invention, as seen from the above description, toner image patches of stabilized density can be formed, whereby reliable image density control can thereby be carried out regardless of insufficient discharge of the toner image patch portions of the transfer belt by the image formation apparatus controlling the image density by detecting the density of toner image patches transferred to the non-image area on the transfer belt.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various modifications as are suited to the particular use contemplated. It is intended that the scope of the invention be defined by the claims appended hereto, and their equivalents.

What is claimed is:

1. An image density controlling device for an image formation apparatus, comprising:

a plurality of image formation means;

a plurality of transfer members to each of which an image formed by at least one of the plurality of said image formation means is transferred;

endless belt means rotating synchronously with the operation of said image formation means for carrying said transfer members, said endless belt means including a plurality of transfer member carrying areas on which the plurality of said transfer members are respectively carried, and a plurality of non-carrying areas therebetween;

means for forming a density detection toner image in said non-carrying area by utilizing at least one of the plurality of said image formation means, the density detection toner image being formed at a non-carrying area in a current rotation cycle different from a non-carrying area in a previous rotation cycle of the endless belt means;

means for detecting a density of said density detection toner image to output a density detection signal representing the detected density;

means for controlling the densities of the images transferred to said transfer members in accordance with said density detection signal;

belt discharging means for removing charges from said endless belt means; and means for cleaning off said density detection toner image during each rotation cycle of said endless belt means.

2. An image density controlling device for an image formation apparatus according to claim 1, wherein said density detection toner image comprises a plurality of toner images which are respectively formed in said non-carrying area by said plurality of image formation means, and said plurality of toner images are in a line extending in a direction orthogonal to a direction of rotation of said endless belt means.

3. An image density controlling device for an image formation apparatus according to claim 1, wherein said density detection toner image comprises a plurality of toner images which are respectively formed in consecutive non-carrying areas by said plurality of image formation means, and said plurality of toner images are in a line extending in a direction of rotation of said endless belt means.

4. An image density controlling device for an image formation apparatus according to claim 1, wherein said density detection toner image comprises a plurality of toner images which are respectively formed in consecutive non-carrying areas by said plurality of image formation means, and said plurality of toner images are in a line extending in a direction of rotation of said endless belt means and in a line extending in a direction orthogonal to the rotation direction.

5. An image density controlling device for an image formation apparatus according to claim 1, wherein said at least one of the image formation means is a first one of the image formation means encountered during each rotation cycle.

6. An image density controlling device for an image formation apparatus according to claim 1, wherein a plurality of density detection toner images are formed by utilizing each of said image formation means, and wherein detections of the densities of all of the plurality of said density detection toner images are carried out together after a last one of said image formation means transfers a toner image.

7. An image density controlling device according to claim 1 wherein each of the image formation means outputs a different color toner, and wherein the one image formation means is used during every other rotation cycle of the endless belt means to form the density detection toner image.

8. An image density controlling device according to claim 1 wherein the image detection toner image means utilizes all of the plurality of image formation means to form separate density detection toner images, and wherein said one of the image formation means is utilized during every other rotation cycle of the endless belt means to form a density detection toner image, and remaining ones of the image formation means are utilized during every rotation cycle of the endless belt means to form density detection toner images.

9. An image density controlling device according to claim 8 wherein said one image formation means outputs a less frequently used toner color.

10. An image density controlling device for an image formation apparatus comprising:

a plurality of image formation means;

endless belt means rotating synchronously with the operation of said image formation means and said endless belt means including a plurality of image transfer areas to each of which an image formed by at least one of the plurality of said image formation means is transferred and a plurality of non-transfer areas therebetween;

means for forming a density detection toner image in said non-transfer area by utilizing at least one of the plurality of said image formation means, the density detection toner image being formed at a non-transfer area in a current rotation cycle different from a non-transfer area in a previous rotation cycle of the endless belt means;

means for detecting a density of said density detection toner image to output a density detection signal representing the detected density;

means for controlling the density of images formed on said endless belt means in accordance with said density detection signal;

at least one transfer member;

means for transferring said image on the image transfer area of said endless belt means to said transfer member;

belt discharge means for removing charges from said endless belt means; and means for cleaning off said density detection toner image during each rotation cycle of said endless belt means.

11. An image density controlling device according to claim 10 wherein each of the image formation means outputs a different color toner, and wherein said one image formation means is used during every other rotation cycle of the endless belt means to form the density detection toner image.

12. An image density controlling device according to claim 10 wherein the image detection toner image means utilizes all of the plurality of image formation means to form separate density detection toner images, and wherein said one of the image formation means is utilized during every other rotation cycle of the endless belt means to form a density detection toner image, and remaining ones of the image formation means are utilized during every rotation cycle of the endless belt means to form density detection toner images.

13. An image density controlling device according to claim 12 wherein said one image formation means outputs a less frequently used toner color.

* * * * *